US005115802A

United States Patent [19]

Dyer

[11] Patent Number: 5,115,802

[45] Date of Patent: May 26, 1992

[54] PELVIC HARNESS

[75] Inventor: Allan E. Dyer, Mississauga, Canada

[73] Assignee: Vat-Tech, Inc., Toronto, Canada

[21] Appl. No.: 633,010

[22] Filed: Dec. 24, 1990

Related U.S. Application Data

[60] Division of Ser. No. 376,154, Jun. 30, 1989, Pat. No. 4,995,378, which is a continuation of Ser. No. 135,533, Dec. 17, 1987, abandoned, which is a continuation of Ser. No. 860,985, May 8, 1986, abandoned.

[51] Int. Cl.[5] ..... A61H 1/02

[52] U.S. Cl. ..... 602/33; 602/36; 606/237

[58] Field of Search ..... 128/71, 78, 84 R, 75, 128/84 C, 72, 70

[56] References Cited

U.S. PATENT DOCUMENTS

| | | | |
|---|---|---|---|
| 1,239,522 | 9/1917 | La Rock | 128/71 |
| 1,242,598 | 10/1917 | Riddle | 128/71 |
| 1,280,987 | 10/1918 | Gregory | 128/71 |
| 1,348,896 | 8/1920 | Riesland | 128/71 |
| 2,660,999 | 12/1953 | Thornton | 128/71 |
| 2,822,805 | 2/1958 | Hill | 128/71 |
| 2,905,715 | 8/1960 | Brobeck | 128/71 |
| 3,176,684 | 4/1965 | Walsh | 128/75 |
| 4,747,399 | 5/1988 | Glumstead | 128/75 |
| 4,865,022 | 9/1989 | Gorsen | 128/71 |
| 4,930,524 | 6/1990 | van Zuilichem | 128/75 |

*Primary Examiner*—Edgar S. Burr
*Assistant Examiner*—Eric Raciti
*Attorney, Agent, or Firm*—Fetherstonhaugh & Co.

[57] ABSTRACT

The invention comprises a pelvic harness for use in applying traction to the lumbar region of a patient. This harness forms a wide waist encircling band to which are attached a pair of posterior straps directly in line with the patient's spinal column and a pair of anterior straps for attachment over the anterior superior spine of the iliac crest of the patient's pelvis. These straps have a length sufficient to extend from the belt between the legs of the patient to connect to a traction device for applying traction to the patient.

2 Claims, 3 Drawing Sheets

PELVIC HARNESS

CROSS REFERENCE TO RELATED APPLICATIONS

This application is a division of application No. 07/376,154 filed June 30, 1989, now U.S. Pat. No. 4,995,378 issued Feb. 26, 1991, which is a continuation of application No. 07/135,533 filed Dec. 17, 1987, now abandoned, which is a continuation of application No. 06/860,985 filed May 8, 1986, now abandoned.

BACKGROUND OF INVENTION

This invention relates to a pelvic belt for use when applying traction to a patient's lumbar region.

Back pain is a common ailment and can represent a painful hindrance that prevents its sufferer from leading a fulfilling life both in leisure and in the workplace. The ailment is very prevalent and there is a need for a non-surgical and efficient form of treatment that would ease this suffering. One form of non-medical treatment is to apply traction to the lumbar region of the spine.

Pelvic belts such as that illustrated in U.S. Pat. No. 1,242,598 dated Oct. 9, 1917, are well known when used for the purposes of applying traction. The belt that Riddle provides has two posterior straps and one anterior strap. The single anterior strap does not serve to provide for attachment over the anterior superior spine of the iliac crest of the patient's pelvis in use and will not, therefore, be fully effective in the application of traction.

In the pelvic belt there is disclosed in U.S. Pat. No. 1,239,522 dated Sep. 11, 1917 and issued to La Rock, the anterior straps are located closely adjacent one another, while the side straps 84 are spaced a substantial distance from one another at the pelvic belt. Again, this structure will not provide the type of attachment that is provided by the present pelvic harness.

U.S. Pat. No. 1,348,896 discloses a pelvic harness which does not include a pelvic belt that encircles the waist and which has only posterior strap.

U.S. Pat. No. 2,822,805 appears to disclose a pelvic belt which has posterior straps and anterior straps that are arranged closely adjacent by another at opposite sides of a waist encircling belt.

SUMMARY OF INVENTION

It is an object of the present invention to provide a pelvic harness which will serve to apply traction directly in line with the patient's spinal column and which will be attached over the anterior superior spine of the iliac crest of the patient's pelvis in use.

According to one aspect of the invention, there is provided a pelvic harness for use in applying traction to the lumbar region of a patient, comprising: a wide pelvic belt for encircling the waist of a patient having an anterior portion and a posterior portion; a pair of anterior strap means each having an end section attached to said anterior portion generally transversely of said anterior portion such that the end sections of said anterior strap means are attached in spaced relationship to each other; a pair of posterior strap means each having an end section attached to said posterior portion transversely of said posterior portion such that, in use, the end sections of said posterior strap means are directly in line with the patient's spine and wherein said attached end sections of said pair of posterior straps are positioned closely adjacent each other relative to said attached end sections of said pair of anterior straps; said posterior and anterior strap means having a sufficient length to extend from the pelvic belt to between the legs of a patient in use and including means for connection to a traction device for applying traction to the spine of a patient; adjustment means between said anterior portion of said pelvic belt and said posterior portion of said pelvic belt for adjusting the circumference of said belt; said attached end sections of said pair of anterior strap means being attached to said anterior portion of said pelvic belt such that they are inclined toward each other in the direction of said means for connection to a traction device and such that the maximum distance between said end sections of said pair of anterior strap means is such that, in use, said anterior strap means are positionable over the anterior superior spines of the Iliac crest of the pelvis of a patient, whereby said pair of anterior strap means may be positioned to pass over the anterior superior spines of the Iliac crest of the pelvis of the patient and said pair of posterior strap means positioned in line with the spine of the patient and the belt tightened on the patient such that said anterior strap means and said posterior strap means retain their positions.

Figure 1:
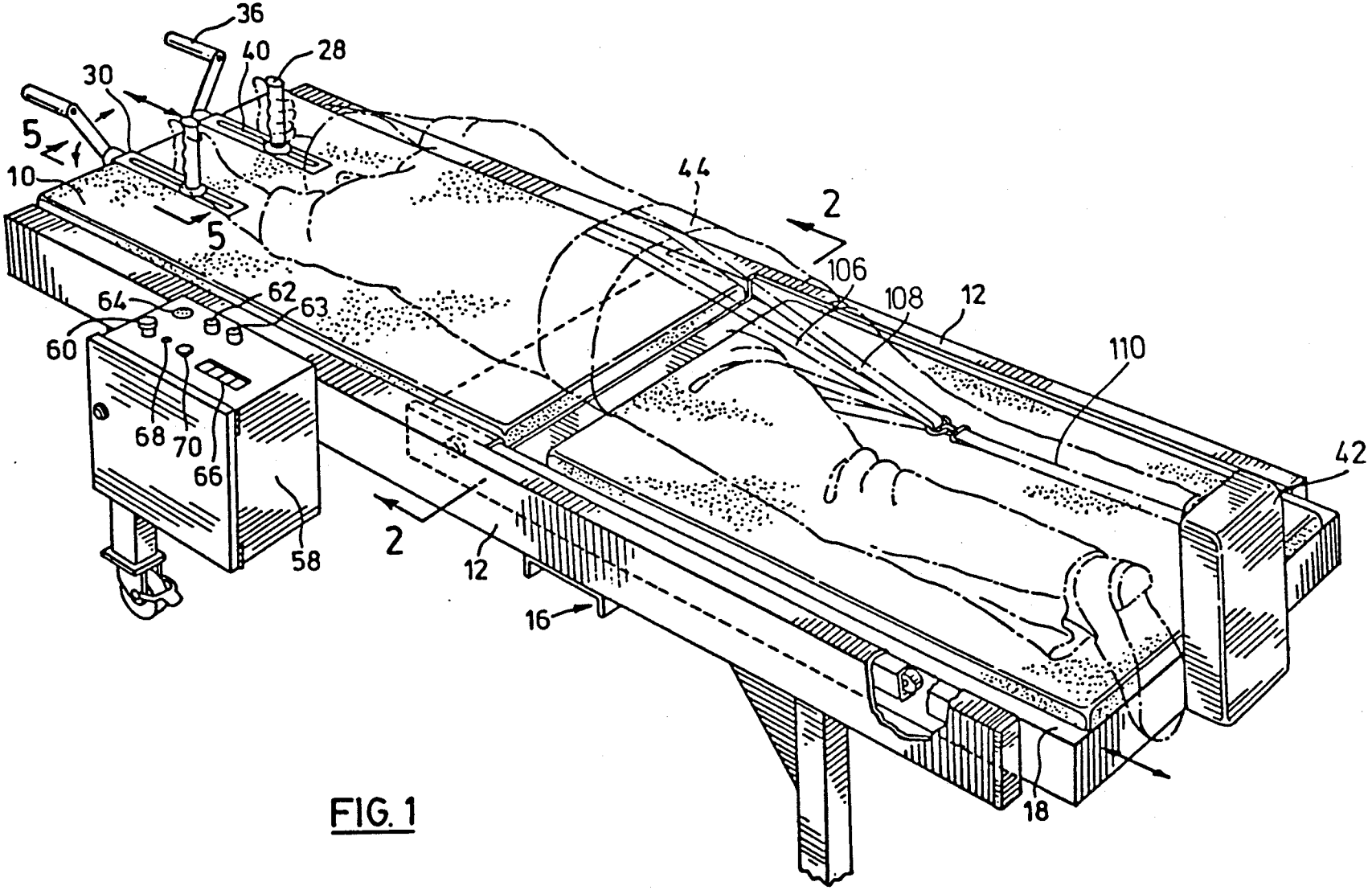
FIG. 1 shows an embodiment of a therapeutic table made according to this invention with a patient drawn in ghost lying prone face down on the table.

The therapeutic table illustrated in the drawings has a table top to support a patient face down as shown in FIG. 1.

The top of the table has an upper body section 10 that extends between channel-like side supports 12. The channel-like side supports 12 extend for the full length of the table but the upper body section 10 remains stationary to support the upper body of a patient in use. By "upper body", it is meant the area of the body above the waist level. The channel-like side supports 12 extend in bifocated fashion below the upper body section 10 and contain tracks 14 for the rollers 19 of the lower body section 18.

Crossmember 16 adds stability to the frame.

Lower body section 18 has laterally extending rollers 19 that engage in the tracks 14 and is slideable with respect to the upper body section 10. In use, the lower body section supports the lower body of the patient. By "lower body" it is meant the portion of the body at and below the waist level.

Figure 2:
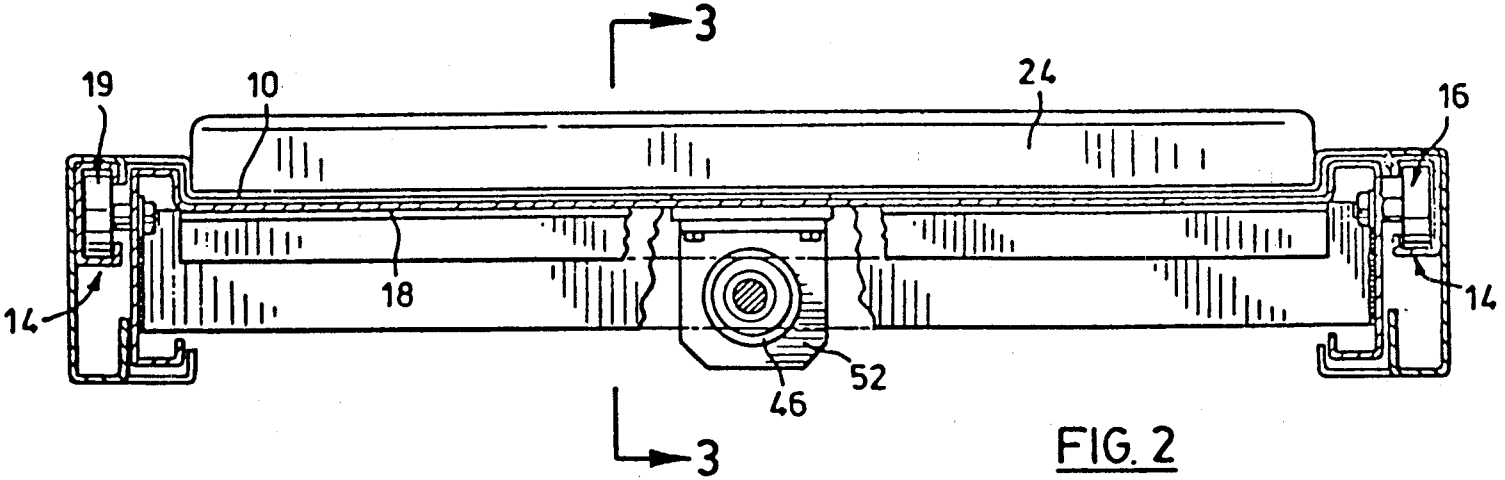
FIG. 2 is a cross section taken along 2—2 of FIG. 1.
Figure 3:
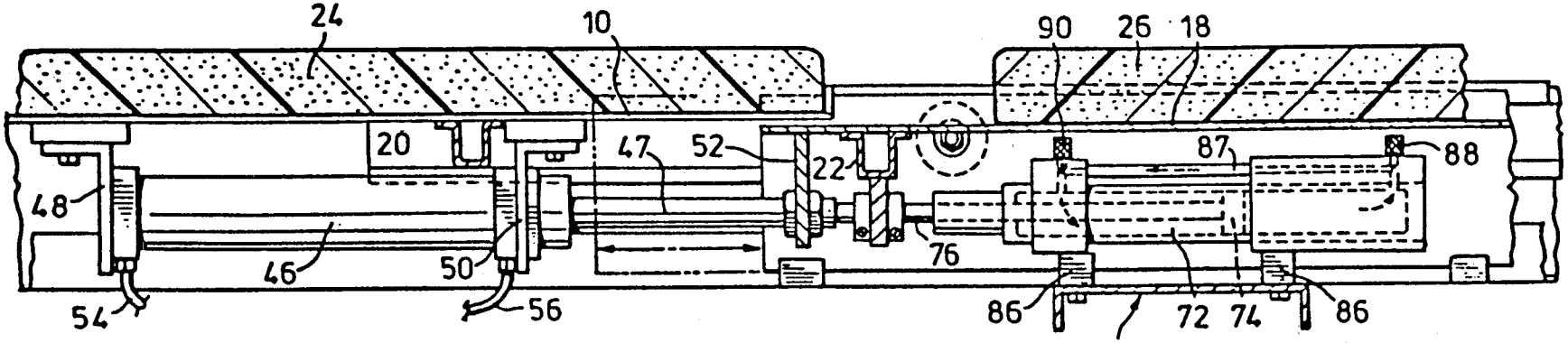
FIG. 3 is a cross section taken along 3—3 of FIG. 2.

The cross sections FIGS. 2 and 3 illustrate the construction of the table sections. The sections are made from sheet metal bent as illustrated. Numerals 20 and 22 designate strengthening channels for the body support sections each of which have cushions 24 and 26. The upper body section 10 is integral with the frame.

It will be apparent from the description thus far that there is provided a table top with two body support sections 10 and 18, one being slideable with respect to the other.

Figure 5:
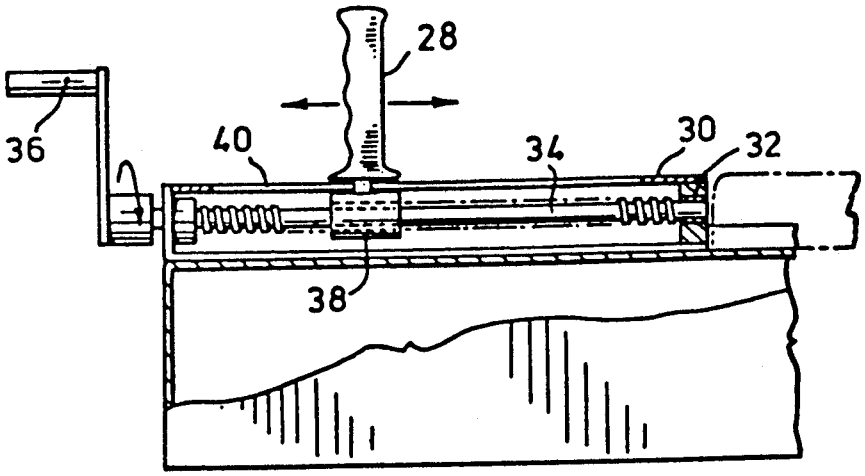
FIG. 5 is a cross-section taken along 5—5 of FIG. 1 showing the adjustable hand grips.

Hand grips 28 are provided. These grips extend from the frame and are adjustable longitudinally of the frame. Their construction is illustrated in FIG. 5. A housing 30 has bearings 32 for the screw 34. Crank 36 is provided to turn the screw in its bearings. A threaded block 38 on the screw extends through a slot 40 in the housing 30 and the handle grip 28 is mounted on the block. It will be apparent that by turning the crank 36, the blocks and their handle grips can be adjusted longitudinally of the table.

The lower body section 18 has a traction measuring meter 42 that also acts as an anchor for the pelvic belt 44. A clasp is mounted to the center of the traction measuring meter 42 to receive an end of a strap 110. In use, the strap is connected to the clasp. This permits an accurate gauging by the traction measuring meter 42 of the tension being applied to the patient. In alternative arrangements, it is possible to mount a bar, that extends horizontally along an axis perpendicular to the longitudinal axis of the table, to the traction measuring meter 42. Straps connected laterally to each side of the pelvic belt 44 could then be attached to opposing ends of the bar to permit bilateral traction of the pelvic belt.

Means are provided for sliding the lower body section 18 with respect to the upper-body section 10 to increase and decrease the distance between the hand grips and the pelvic anchor whereby one can controllably apply traction to the spine. In the embodiment shown the means comprises a double acting air cylinder 46. The air cylinder 46 is rigidly mounted with respect to the frame and upper body section 10 by brackets 48 and 50; and the free end of its piston rod 47 connects with a bracket 52 that depends from the bottom of the lower body section 18.

It will be apparent that as the piston rod 47 moves outwardly, the lower body section moves away from the upper body section and that as the piston rod 47 moves inwardly the lower body section moves towards the upper body section.

The pneumatic cylinder 46 has two inlets 54 and 56. Air to inlet 54 moves the piston rod 47 to the right and air to inlet 56 moves the piston rod 47 to the left in FIG. 3.

Air supply to the inputs 54, 56 is regulated by the operator through the use of a control box 58. The control box includes a pressure regulator switch 60 for setting the pressure of the air fed to the cylinder 46. A timer 62 controls the application of pressure to the two inlets of the cylinder 47. It applies pressure to inlet 54 for a predetermined time, then cuts supply to inlet 54 and applies it to inlet 56. It does this cyclically for the duration of treatment. A pause timer 63 regulates the amount of pause for which the lower body section 18 remains against the upper body section between cycles. When the lower body section 18 is drawn back against the upper body section 10, the pause timer is activated to hold the table sections in closed relationship for a set period. After the period set by the pause timer 72 has elapsed, the air is cut off from being fed into inlet 56 and is applied into inlet 54. This starts the cycle over again. A pressure gauge 64 gives a reading of the input pressure. A traction tension gauge 66 gives a reading of the traction applied to the pelvic belt 44 as determined by the traction measuring meter 42. A start button 68 is pushed to commence the treatment, and a stop button 70 may be pressed to terminate the treatment. Alternatively, a timer (not shown) may be used to terminate treatment.

The interconnection of these controls has not been illustrated in detail. Their use is well known and the person skilled in the art could connect them to perform the stated functions.

At the commencement of the treatment, the table sections are in or close to abutting relation. Air pressure, predetermined to the patient's needs, is admitted through inlet 54 to extend the piston rod 47 and carry the lower body section 18 outwardly. This applies traction to the patient's lumbar region. The predetermined tension is eventually achieved and held until the time set by the treatment timer expires, air pressure is cut off from inlet 54 and applied to inlet 56 to retract the piston rod 47 and lower body section 18 as noted above. When the table sections are in abutting relationship, they are held in that position for the duration of time as set by the pause timer. This cycle is repeated for the period set by the timer 62.

The cyclical nature of the treatment can be controlled automatically. After setting the amount of traction by dial 64, one sets the time of application of traction by dial 62 and the amount of pause by dial 63. The total amount of time of treatment may also be automatically set by a dial (not shown).

Traction is usually applied for between 0.5 minutes to 1 minute; rest periods usually vary for similar duration. The cycle is repeated 10 to 20 times and treatments are beneficially given from 1 to 3 times a day. Variations are of course possible. The foregoing are only by way of example.

The detailed connection of the controls to achieve the supply and direction of the pneumatic pressure as described is not shown in detail. It is capable of variation and well known to those skilled in the art.

Thus there is provided means for cyclically applying traction to the spine. The pressures and the times are a matter of medical skill and practice.

Means are preferably provided for restraining the rate of movement of the lower body section. It will be apparent that air is admitted suddenly to the pneumatic cylinder and that if the resulting rate of movement of the lower body section is unrestrained, it could cause discomfort. In the embodiment illustrated, this difficulty is overcome by a hydraulic force-absorbing device which slows the rate of movement until the pneumatic cylinder reaches the full extent of its travel.

A cylinder 72 with a piston 74 between its ends has a piston rod 76 secured to the lower-body section 18 as at 84. The cylinder is rigidly mounted on the frame as at 86.

The cylinder 72 is filled with a hydraulic fluid and has a fluid bypass 87 extending from one end to the other. Needle valve 88 controls the rate of flow through the bypass in one direction and needle valve 90 controls the rate of flow through the bypass in the other direction.

When the lower body section moves outwardly, the piston 74 moves to the right and displaces fluid from the right end of the cylinder through the bypass 87 and the valve 88 to the left end of the cylinder. The valve is adjusted to provide resistance to this displacement and thus control the rate of movement of the lower body section 18 under the influence of the pneumatic pressure in the cylinder 46 as it applies traction.

As noted, the application of traction is for a predetermined time only. After traction has been applied for the predetermined time the action of the pneumatic cylinder is reversed.

The lower body section 18 retracts and the piston 74 in the hydraulic cylinder 87 moves to the left direction as viewed in FIG. 3. As it does so, hydraulic fluid moves from the left section to the right section through the bypass conduit 87 and needle valve 90. Needle valve 90 is adjusted to achieve a proper rate of movement by initially resisting the movement of the pneumatic piston.

The needle valves are adjusted to achieve rate of movement as required to provide a comfortable slow rate of applying traction and retraction to the patients.

The pelvic belt 44 is secured around the patient's pelvic region. It has two sections 92 and 94 which are secured round the patient's body by straps 96 and 98 and buckles 100 and 104. Extending from the belt are pull straps 106 and 108. As illustrated in FIG. 1, straps 110 connects the straps 106 and 108 to the pelvic belt traction measuring meter 42. In use, when the table separates, the lower-body support section 18 slides rearwardly and causes tension to develop to provide traction to the patient's lumbar region. The single strap belt may be replaced with a multi-strap belt if desired.

Figure 4:
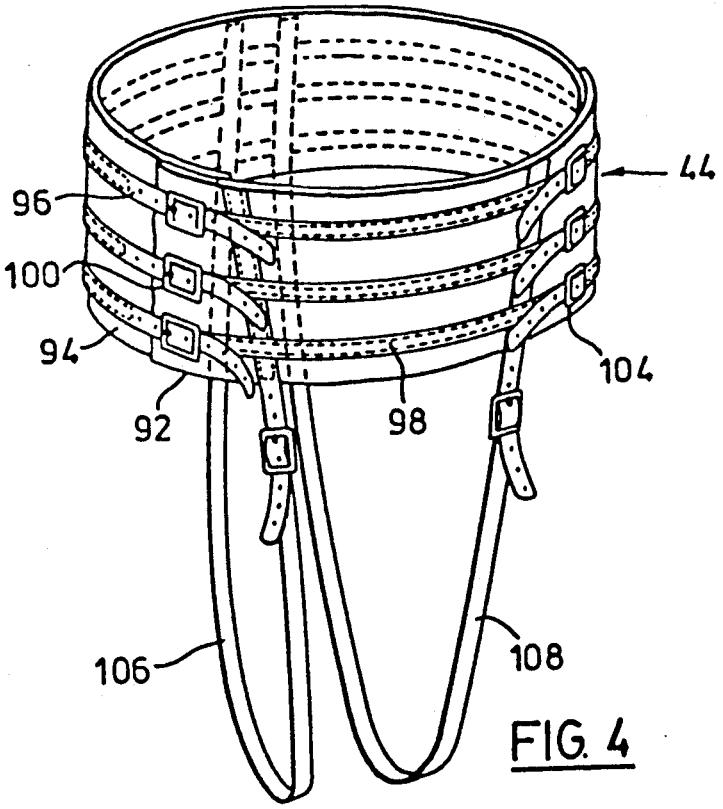
FIG. 4 shows a belt that may be used in combination with this invention.

The pelvic belt is designed so that the straps are connected to the pelvic belt in a manner which locates the posterior straps directly in line with the patient's spinal column. The anterior straps are attached to the belt so as to position the attachment over the anterior superior spine of the Iliac crest of the pelvis. As seen in FIG. 4, the belt attached end sections of the posterior straps are positioned closely adjacent each other relative to the spacing between the belt attached end sections of the anterior straps.

The lateral traction pelvic belt is designed with straps attached to each side of the belt.

It will be appreciated that the patient may be further secured at his upper body region to the upper body section by a thoraic vest attached to the upper body section but it has been found that the patient is more comfortable without this attachment. Generally, when the patient's upper body is anchored by voluntary hand gripping, he tends to be more relaxed because he is aware that if the traction applied is excessive he can let go. The patient, himself, can also terminate the cycle and treatment session by pressing the stop button 70 which is within the patient's reach on the control box 58.

When the therapeutic table is started, the lower body section abuts the upper body section. The pressure of operation for the pneumatic cycle is set as determined by a qualified medical person with the pressure regulator switch 60. The timer 62 which directs the application of pressure between the two inlets is also set. In the embodiment illustrated, treatment sessions are terminated by pressing the stop button 70 but, alternatively, a second timer, if provided, may be preset to terminate the treatment when the end of the treatment period should occur.

The needle valves 88, 90 on the hydraulic restraining cylinder may also be adjusted to provide a desirable rate of separation.

After the belt has been secured to the patient and the patient is prone face down as shown in FIG. 1, the treatment may be commenced.

When the operation has been commenced, air pressure is forced through inlet 54 into the pneumatic cylinder 46 to move its piston and piston rod 47. The movement of the piston rod 47 pushes the lower body section 18 away from the upper body section 12. When the lower body section 18 moves, so does the hydraulic piston rod 76 and piston 74. The rate of separation of the lower body section is retarded by the rate of hydraulic fluid permitted to flow past needle valve 88 of bypass conduit 87.

After a period as set by timer 62 has expired, air pressure is redirected by the pumping means to enter the pneumatic cycle through inlet 56 instead of 54. This pushes the pneumatic piston 74 and piston rod 76 in the opposite direction to pull the lower body section 18 toward the upper body section 10. As aforementioned, when the lower body section 18 moves, so does the hydraulic piston rod 76 and the piston 74. However, the rate of closure of the two table sections is retarded by the rate that the hydraulic fluid permitted to flow past needle valve 90 of bypass conduit 87.

The distance of separation for the table sections is usually between 0 to 6 inches to take up slack in the belts and connections.

The time period for traction and relaxation are to be set to suit the particular requirements of the patient. After closure has been achieved and held for the specified period of pause, the air pressure will be again automatically redirected to the inlet 54 to start the cycle over again. These cycles are repeated for the duration of the treatment session.

It should be appreciated that aside from the pressures being applied to separate the table, there will be a frictional force between the patient and the table that will affect the separation of the sections. Because most of the weight of the patient is in his upper body, a substantial amount of this friction will be exerted against the upper body section 10. There are two obvious effects of this. Firstly, the friction of the upper body will reduce the amount of strength required by the patient for gripping the hand grips 28 when the sections are separating. Secondly, there is a lesser proportion of the patient's body weight resting on the lower-body section 18 that must be moved by the pneumatic piston.

The amount of pressure used for treatment is a function of the traction required for the patient and is determined by a qualified medical practitioner to suit the particular condition of the patient. This may vary between 25 pounds per square inch and 60 pounds per square inch for a pneumatic piston having a diameter of about 2 inches. The tension reading should be in the area of between 35 to 60 Kilo grams again depending on the condition of the patient. The average will be about 45 Kilograms.

The precise strength of traction registered by the traction measuring meter 42 is translated to digital readout on the traction tension gauge 66.

The traction measuring meter 42 which measures the tension is a device that is readily available on the market and a person skilled in the art would have no difficulty in incorporating it with a translating means for the purpose disclosed herein.

It will be noted that, in the embodiment illustrated, the moving parts of the table are pneumatically driven and that the patient does not come into contact with any electrically driven parts. In result, the patient is not subject to the danger of electrical shock. The meters used are battery-powered from a low-voltage power source.

The invention provides a non-surgical therapeutic table that is efficient to use and that alleviates back pain by cyclically applying traction and relaxation predetermined in respect of amount and time to the lumbar region through the use of a separating table.

It will be recognized that the embodiment illustrated is only one embodiment within the broader scope of this invention as herein claimed.

We claim:

1. A pelvic harness for use in applying traction to the lumbar region of a patient, comprising:

a wide pelvic belt for encircling the waist of a patient having an anterior portion and a posterior portion;

a pair of anterior strap means each having an end section attached to said anterior portion generally transversely of said anterior portion such that the end sections of said anterior strap means are attached in spaced relationship to each other;

a pair of posterior strap means each having an end section attached to said posterior portion transversely of said posterior portion such that, in use, the end sections of said posterior strap means are directly in line with the patient's spine and wherein said attached end sections of said pair of posterior straps are positioned closely adjacent each other relative to the spacing between said attached end sections of said pair of anterior strap means;

said posterior and anterior strap means having a sufficient length to extend from said pelvic belt to between the legs of a patient in use and including means for connection to a traction device for applying traction to the spine of a patient;

adjustment means between said anterior portion of said pelvic belt and said posterior portion of said pelvic belt for adjusting the circumference of said belt;

said attached end sections of said pair of anterior strap means being attached to said anterior portion of said pelvic belt such that they are inclined toward each other in the direction of said means for connection to a traction device and such that the maximum distance between said end sections of said pair of anterior strap means is such that, in use, said anterior strap means are positionable over the anterior superior spines of the Iliac crest of the pelvis of a patient, whereby said pair of anterior strap means may be positioned to pass over the anterior superior spines of the Iliac crest of the pelvic of the patient and said pair of posterior strap means positioned in line with the spine of the patient and the belt tightened on the patient such that said anterior strap means and said posterior strap means retain their positions.

2. The pelvic harness of claim 1 wherein said anterior portion of said pelvic belt comprises an anterior band and wherein said posterior portion of said pelvic belt comprises a posterior band, and wherein said adjustment means comprises engagement means proximate either end of said anterior band and complementary engagement means proximate either end of said posterior band for engaging with said engagement means of said anterior band; said engagement means of said posterior and anterior bands permitting the adjustment of the circumference of said pelvic belt without repositioning the attached end sections of said anterior strap means with respect to the anterior superior spines of the Iliac crest of the pelvis of a patient and without repositioning the end sections of said posterior strap means with respect to the patient's spine.

* * * * *